US005855040A

United States Patent [19]

Lin

[11] Patent Number: 5,855,040

[45] Date of Patent: Jan. 5, 1999

[54] HINGE STRUCTURE OF ROTARY DOOR

[75] Inventor: Wen-Chi Lin, Taichung Hsien, Taiwan

[73] Assignee: Dawnwell Int'l Co., Ltd., Taipei, Taiwan

[21] Appl. No.: 828,510

[22] Filed: Mar. 31, 1997

[51] Int. Cl.[6] ..... E05F 3/20

[52] U.S. Cl. ..... 16/50; 16/54; 16/71

[58] Field of Search ..... 16/50, 54, 71, 16/68, 378, 379, 81, 312, 316, DIG. 21

[56] References Cited

U.S. PATENT DOCUMENTS

| | | | |
|---|---|---|---|
| 4,068,344 | 1/1978 | Okabe | 16/54 |
| 4,073,037 | 2/1978 | Curry et al. | 16/50 |
| 4,155,144 | 5/1979 | Koganei | 16/54 |
| 4,756,051 | 7/1988 | Shy | 16/50 |
| 5,152,029 | 10/1992 | Pai | 16/54 |
| 5,383,253 | 1/1995 | Lin | 16/50 |

*Primary Examiner*—Chuck Y. Mah
*Attorney, Agent, or Firm*—Browdy and Neimark

[57] ABSTRACT

A hinge structure of rotary door, including a mechanical rotary hinge and a buffering rotary hinge inserted in a hinge casing. An upper section of the rotary shaft of the buffering rotary hinge is formed with two opposite ring seats. A flange body is slidably fitted around the rotary shaft between the ring seats. An upper and a lower edges of the flange body and the ring seats are respectively disposed with corresponding projecting wedge edges and recessed wedge edges so as to lift or lower the rotary shaft along with the opening or closing of the door. A flange body is formed with an insertion hole and the ring seat is formed with a slide slot to be inserted in the casing. A piston body disposed with oil seal ring is fitted with the end of the rotary shaft to be slidably disposed in an oil cylinder. The piston body is formed with an annular groove communicated with a lower chamber by several through holes for fast opening the door. The rotary shaft in the piston body is disposed with an oil vent communicated with the cenrtral shaft hole at the up per and lower chambers to buffer the closing the door. The end of the inner wall of the oil cylinder is formed with an expansion section for releasing the buffering force at the end stage of closing of the door.

1 Claim, 9 Drawing Sheets

HINGE STRUCTURE OF ROTARY DOOR

BACKGROUND OF THE INVENTION

1. Technical Field of the Invention

The present invention relates to a hinge structure of rotary door. An upper section of the rotary shaft of the buffering rotary hinge is formed with two opposite ring seats. A flange body is slidably fitted around the rotary shaft between the ring seats. The lower section of the rotary shaft is disposed with a piston body slidably fitted in an oil cylinder to form a buffering rotary hinge, whereby the closing of the door is buffered and the door can be easily opened. The buffering force at the end stage of closing of the door is released to accurately close the door.

2. Prior Art

FIGS. 1 and 2 show a conventional mechanical hinge structure of rotary door. The hinge 10 has a rotary shaft 11 around which an insertion seat 12, a rotary spring 13, a ring-shaped flange body 14, a ring-shaped slide seat 15, a compression spring 16 and a mating pad seat 17 are sequentially fitted. The inner rim of the insertion seat 12 is formed with annular ratchets 18 and the top edge thereof is disposed with a pushing projection 19. The rotary shaft 11 is formed with a transverse hole 20 in which a resilient member 21 and a one-way ratchet 23 with a guide slot 22 are fitted to abut against the annular ratchets 18. A restricting member 24 is slidably inserted from the top of the rotary shaft 11 into the guide slot 22. Two ends 25 of the rotary spring 13 between the insertion seat 12 and the flange body 14 are respectively inserted into an upper and a lower insertion holes 26. Between the flange body 14 and the slide seat 15 are disposed corresponding projecting wedge edge 27 and recessed wedge edge 28. The flange body 14 is formed with an insertion hole 29 and the slide seat 15 is formed with a slide channel 30, whereby when inserted into the casing 31 of the hinge and relatively rotated, the slide seat 15 pushes the lower compression spring 16. When rotarily restored, the compression spring 16 and rotary spring 13 relatively act on the projecting wedge edge 27 of the flange body 14 and the recessed wedge edge 28 of the slide seat 15 to slide and rotate so as to automatically restore and close the door.

However, in use, without any buffering device, the mechanical rotary hinge 10 will act on the door to close the door at a high speed with great noise. In addition, due to collision, the door is apt to be damaged. Moreover, the door is disposed with at least two mechanical rotary hinges 10 which exert an excessively great reactional pushing force when the door is opened. Therefore, it is difficult to open the door.

SUMMARY OF THE INVENTION

It is therefore a primary object of the present invention to provide a hinge structure of rotary door in which an upper section of the rotary shaft of the buffering rotary hinge is formed with two opposite ring seats. A flange body is slidably fitted around the rotary shaft between the ring seats for lifting or lowering the rotary shaft when opening or closing the door. The lower section of the rotary shaft is disposed with a piston body slidably fitted in an oil cylinder to form a buffering rotary hinge, whereby the closing of the door is buffered and the door can be easily opened. The buffering force at the end stage of closing of the door is released to accurately close the door.

The present invention can be best understood through the following description and accompanying drawings, wherein:

DETAILED DESCRIPTION OF THE PREFERRED EMBODIMENT

Figure 1:
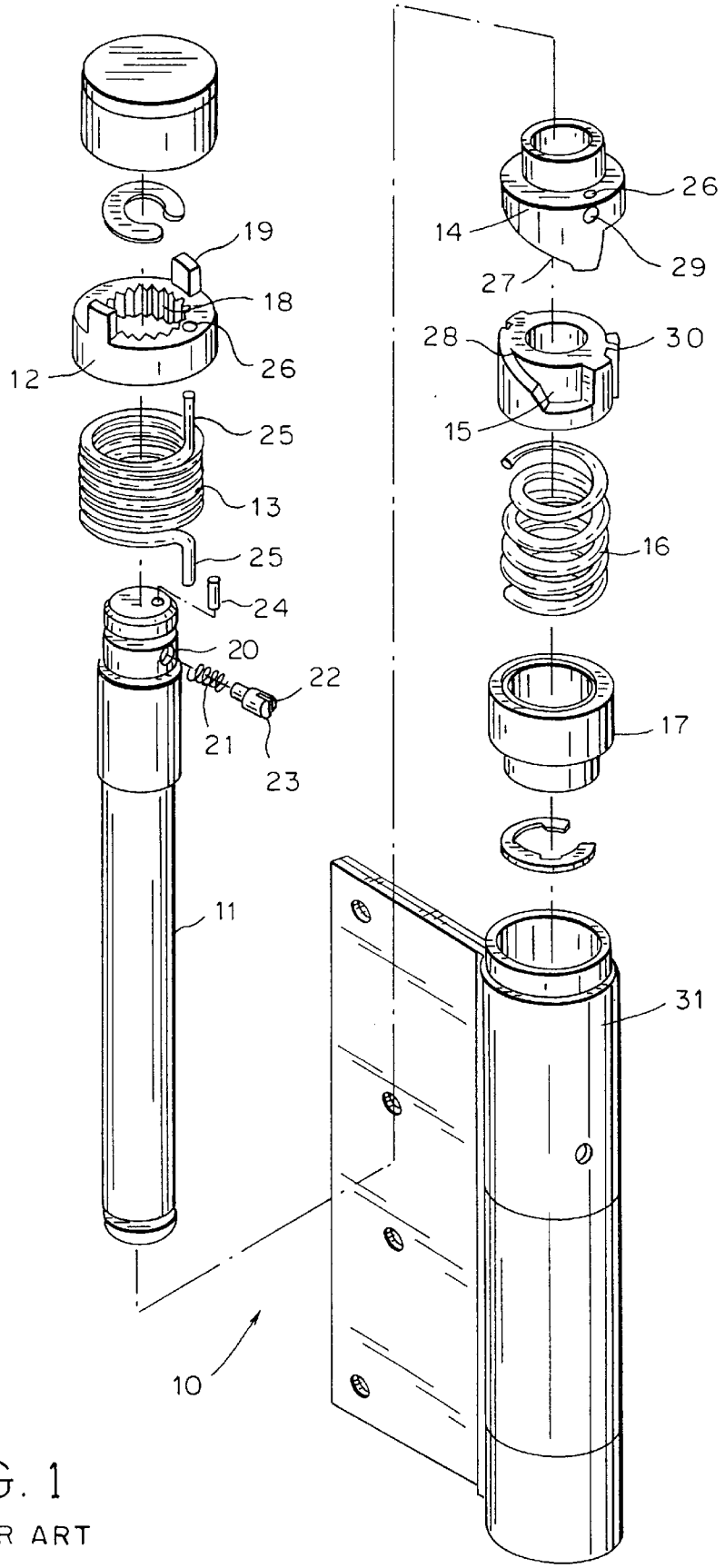
FIG. 1 PRIOR ART
FIG. 1 is a perspective exploded view of a conventional mechanical rotary hinge.
Figure 2:
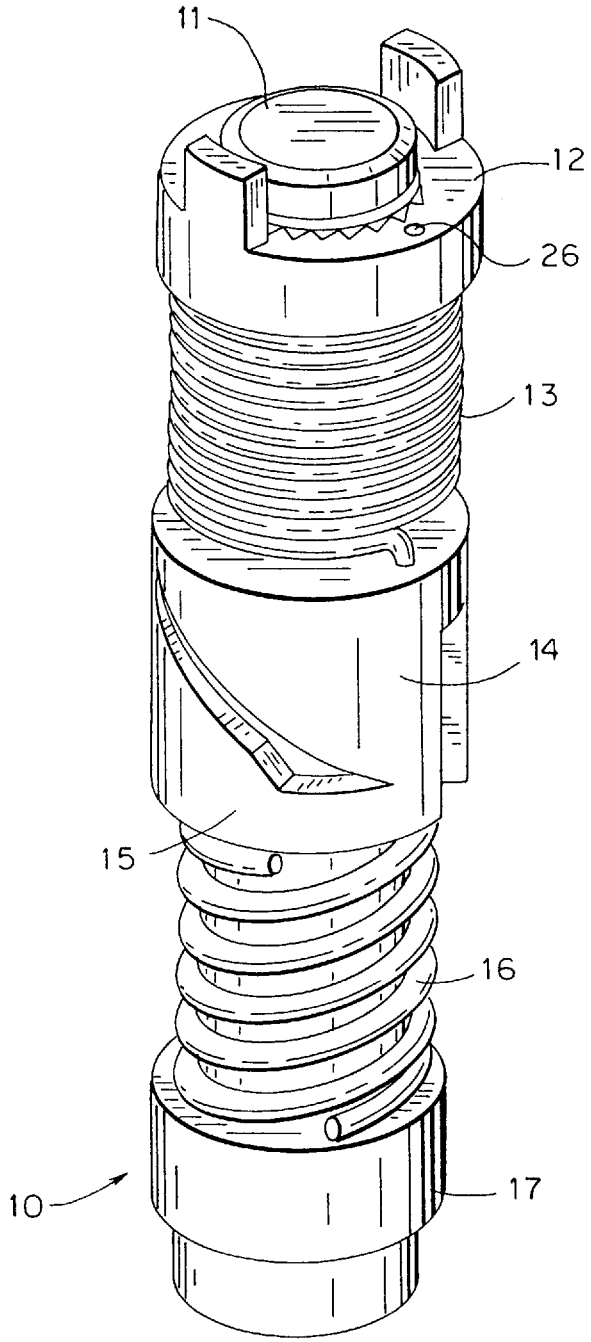
FIG. 2 PRIOR ART
FIG. 2 is a perspective assembled view of the conventional mechanical rotary hinge.
Figure 3:
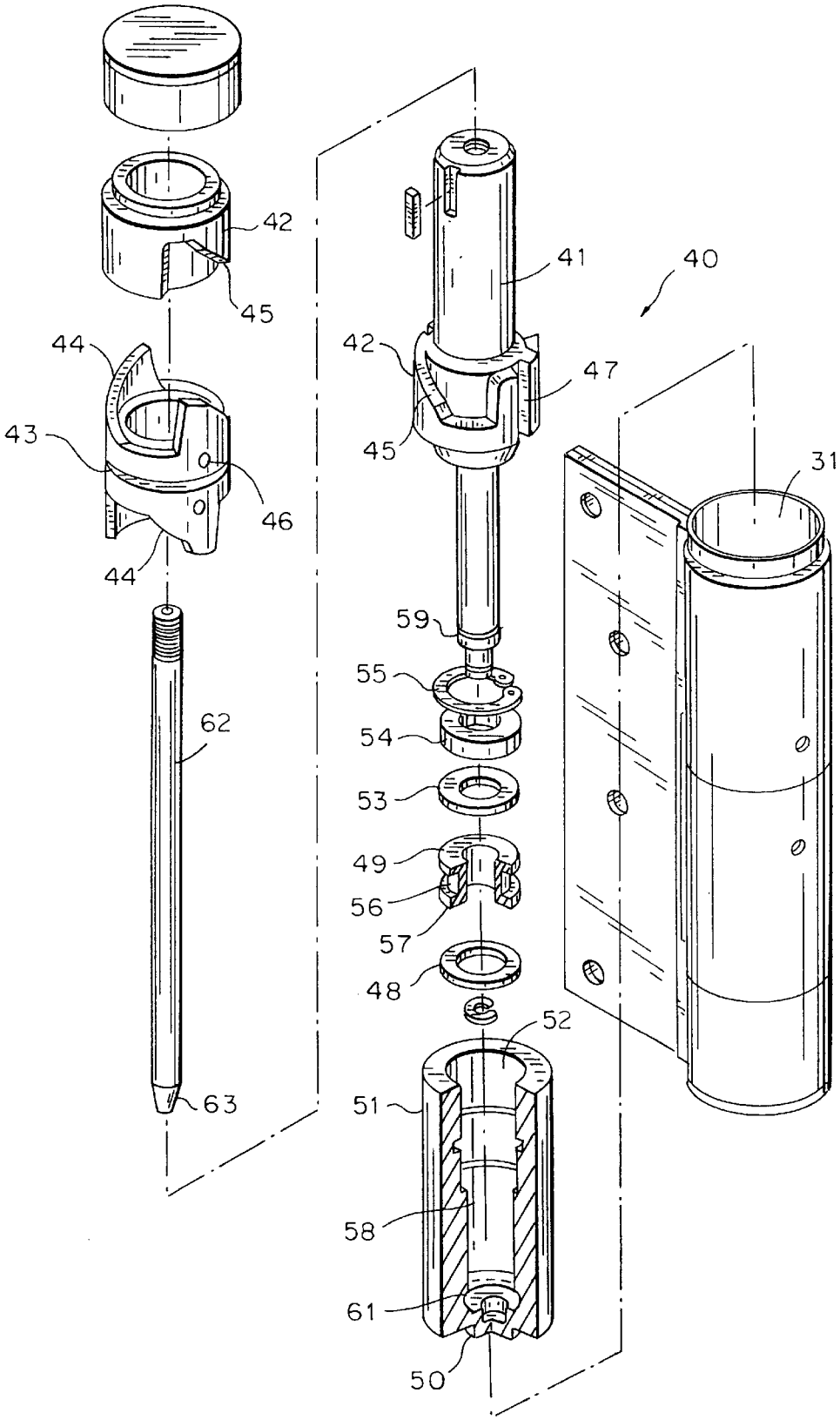
FIG. 3 is a perspective exploded view of the buffering rotary hinge of the present invention.
Figure 4:
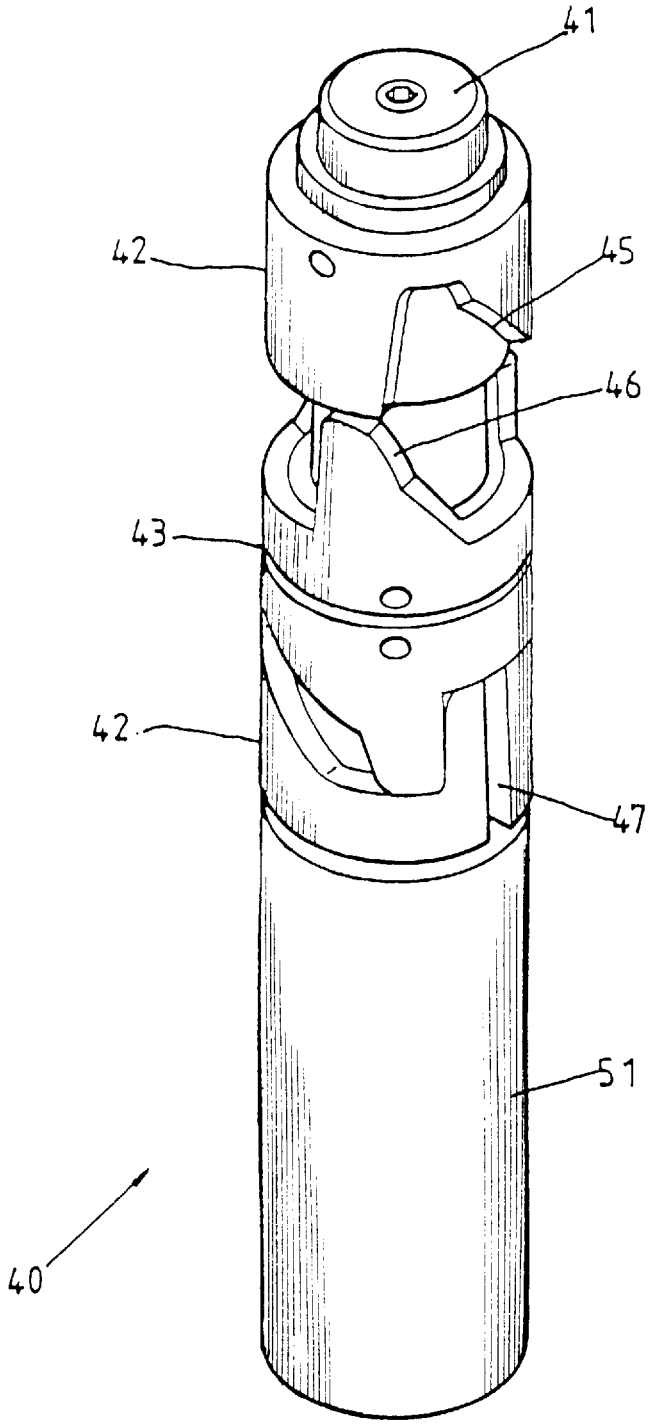
FIG. 4 is a perspective assembled view of the buffering rotary hinge of the present invention.
Figure 5:
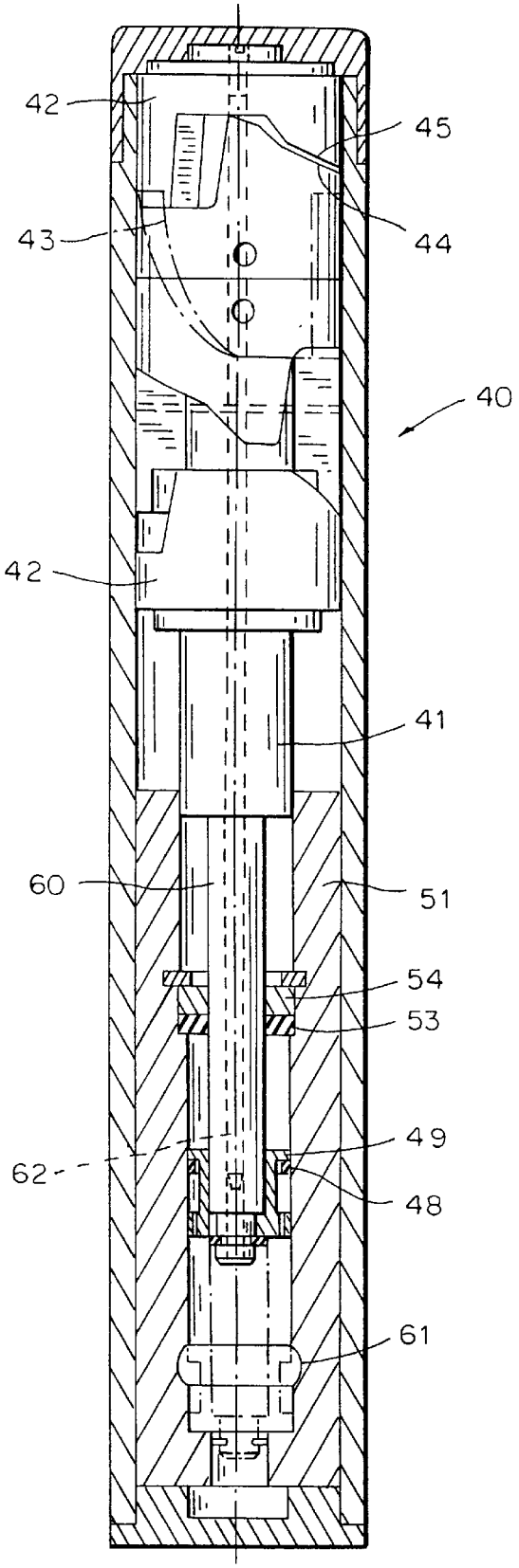
FIG. 5 is a sectional assembled view of the buffering rotary hinge of the present invention.
Figure 6:
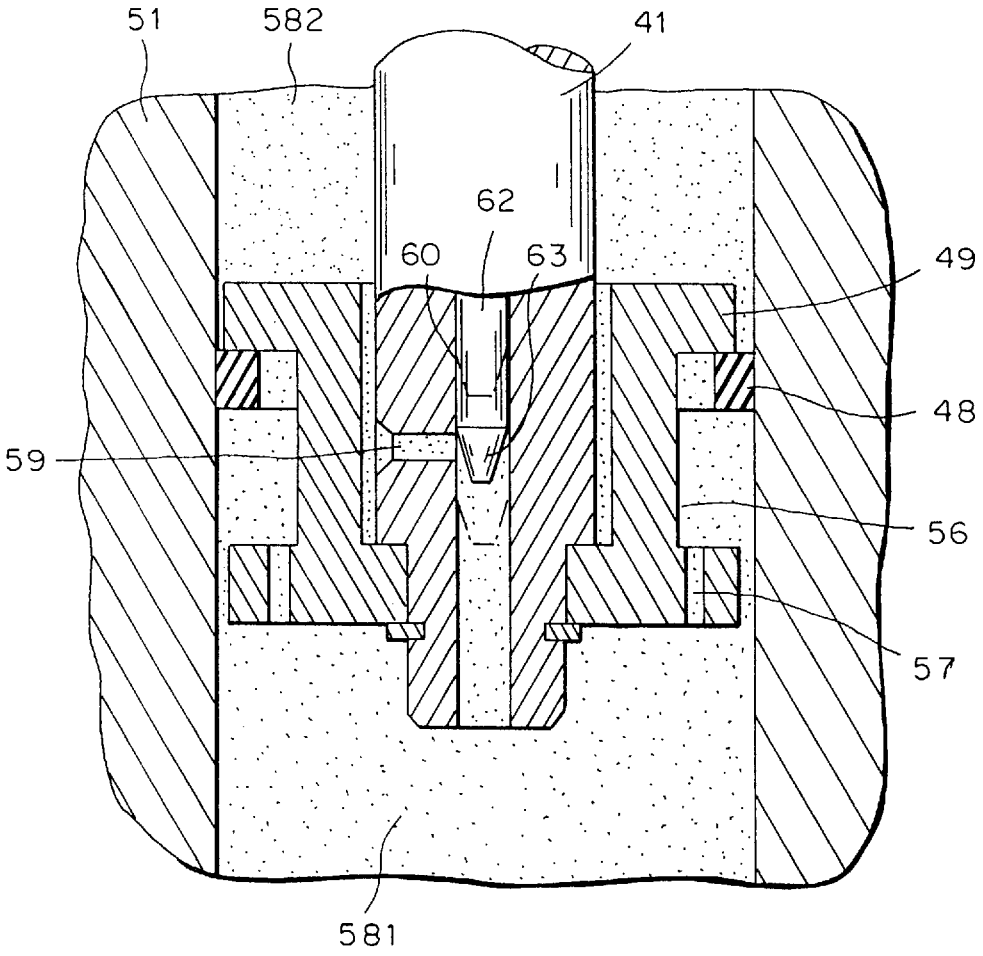
FIG. 6 is a sectional assembled view of a part of the buffering rotary hinge of the present invention.

Please refer to FIGS. 3 and 4. The hinge structure of the present invention includes a mechanical rotary hinge 10 adapted to be fixed to a door and a set of buffering rotary hinge 40 inserted in the hinge casing 31 adapted to be fixed to a door or frame. The upper section of the rotary shaft 41 of the buffering rotary hinge 40 is formed with an upper ring seat 42 and a lower ring seat 42, 42. A flange body 43 is slidably fitted around the rotary shaft 41 between the ring seats 42, 42. The upper and lower edges of the flange body 43 and the ring seats 42, 42 are respectively disposed with corresponding projecting wedge edges 44 and recessed wedge edges 45. The flange body 43 is formed with an insertion hole 46 and the lower ring seat 42 is formed with a slide slot 47 to be inserted in the casing 31. Referring to FIGS. 5 and 6, a piston body 49 disposed with oil seal ring 48 is fitted with the end of the rotary shaft 41 slidably disposed in an oil cylinder 51 having mating seat 50 at the end. Between the opening 52 of the oil cylinder 51 and the rotary shaft 41 are sealed an oil seal body 53, a washer body 54 and a cooperative latch ring 55. The piston body 49 is formed with an annular groove 56 which communicates with a lower chamber 581 by several through holes 57. The rotary shaft 41 in the piston body 49 is disposed with an oil vent 59 which communicates with the central shaft hole 60 at the upper and lower chambers 582, 581. The end of the inner wall of the oil cylinder 51 is formed with an expansion section 61.

The central shaft hole 60 of the rotary shaft 41 extends to the top thereof to be screwed with a rod member 62 with a conic head 63 protruding through the intersection portion of the central shaft hole 60 and the oil vent 59.

Figure 7:
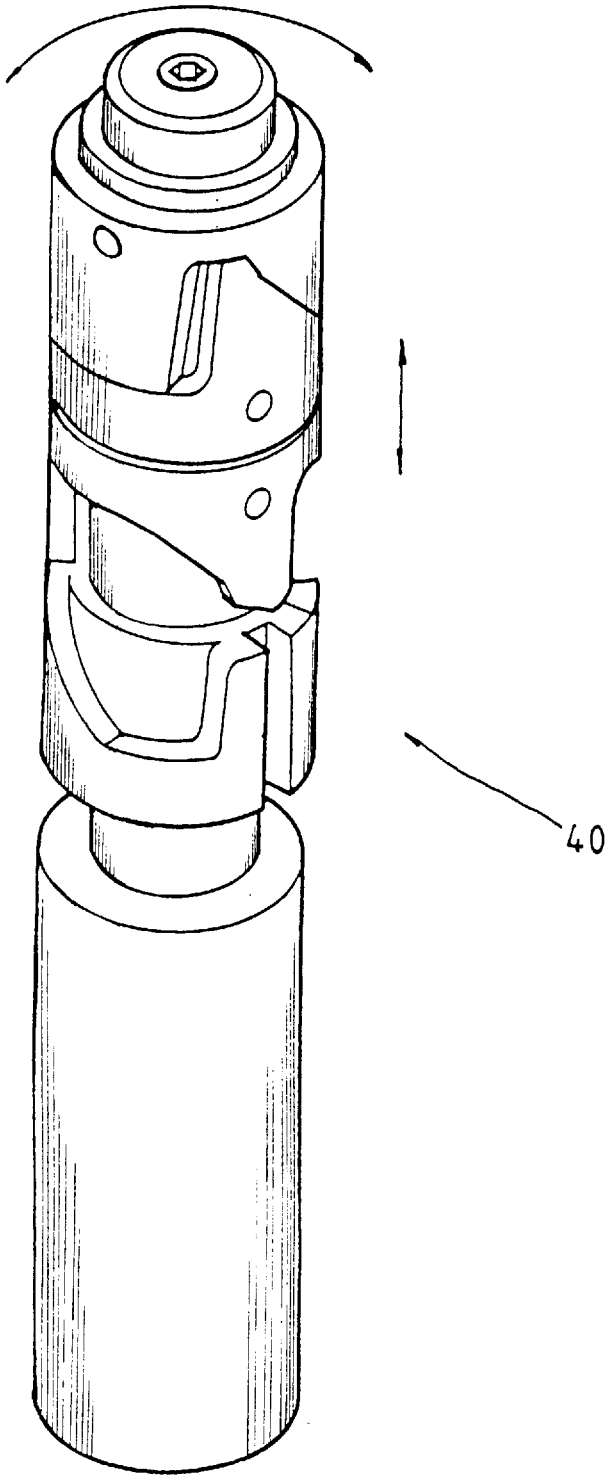
FIG. 7 is a perspective view showing the operation of the buffering rotary hinge of the present invention.
Figure 8:
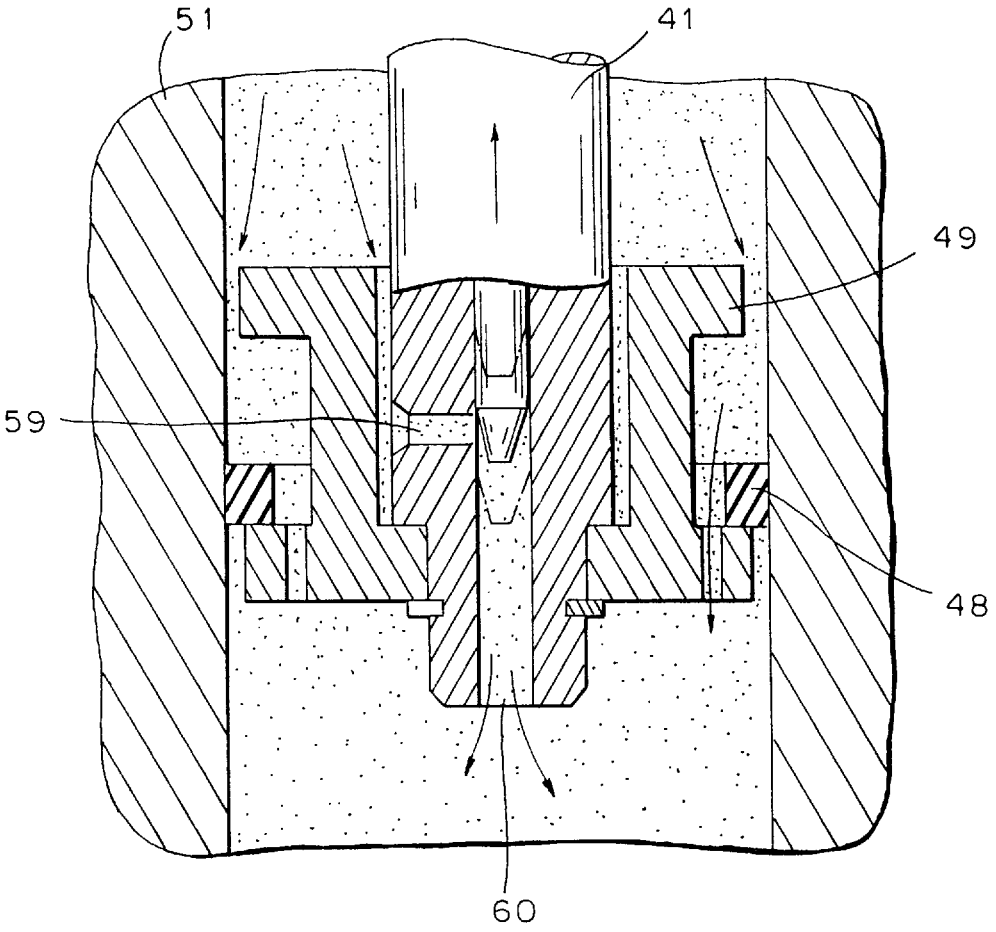
FIG. 8 is a sectional view showing the operation of the buffering rotary hinge of the present invention in one state.

Referring to FIGS. 7 and 8, the clearance between the lower section of the rotary shaft 41 and the piston body 49 communicates with the upper and lower chambers 582, 581 by the oil vent 59 and the central shaft hole 60 as an oil Path which is relieved in normal state. When the door is moved with the insertion hole 46 and the slide slot 47 relatively displaced, the projecting wedge edge 44 of the flange body 43 and the recessed wedge edge 45 of the ring seat 42 are relatively guided and slided. In addition, the ring seat 42 integrally acts on the rotary shaft 41 to lift the same. At this time, the oil seal ring 48 on the annular groove 56 of the piston body 49 is attached to the inner wall of the oil cylinder 51 to slide down to the bottom of the annular groove 56 so as to open the gap between the upper edge of the piston body 49 and the inner wall of the oil cylinder 51. In cooperation with the through holes 57 of lower edge of the piston body 49, the upper and lower chambers 582, 581 are communicated as another open oil path. Therefore, when the door is opened, the buffering rotary hinge 40 does not work so as to facilitate opening of the door.

Figure 9:
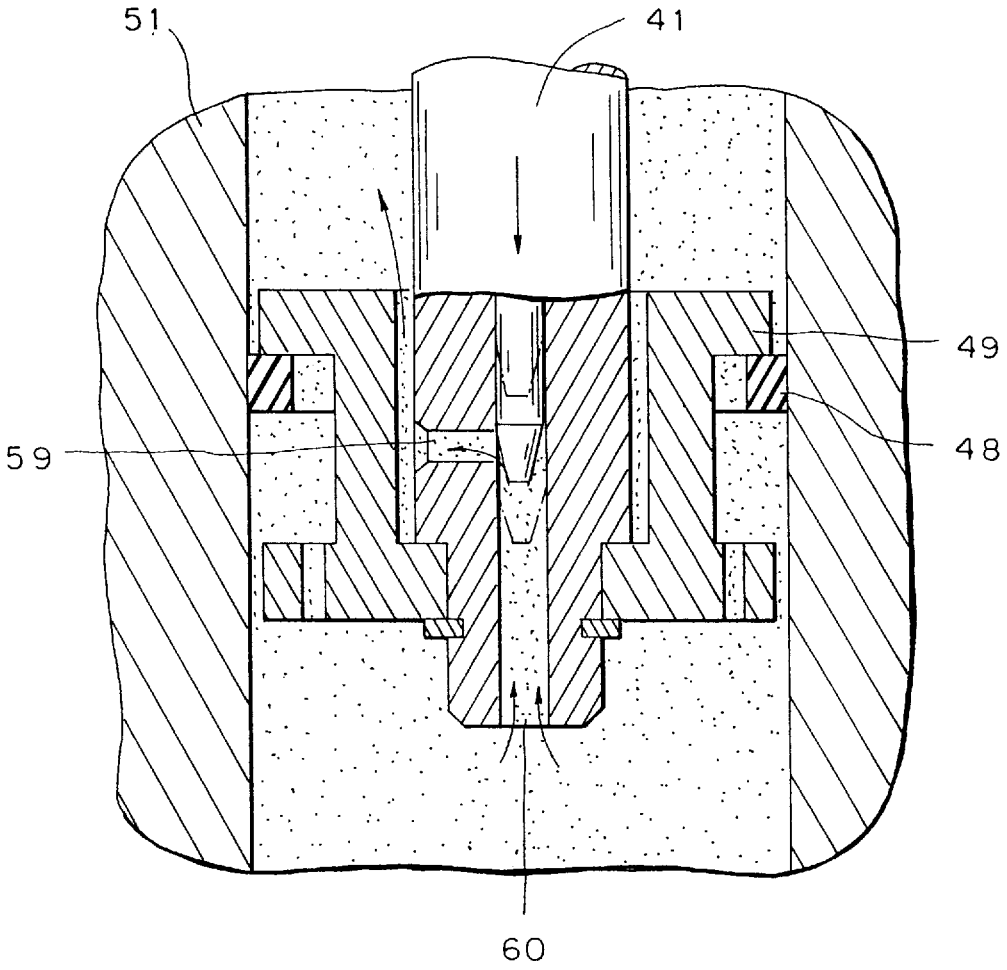
FIG. 9 is a sectional view showing the operation of the buffering rotary hinge of the present invention in another state.

After the opened door is released or disengaged from the located state of the top ends of the projecting wedge edge 44 and recessed wedge edge 45, the mechanical rotary hinge 10 provides a rotational restoring force. The upper ring seat 42 of the buffering rotary hinge 40 by means of the relatively guiding and sliding of the projecting wedge edge 44 and recessed wedge edge 45 integrally depresses and slides down the rotary shaft 41 as shown in FIGS. 7 and 9. At this time, the oil seal ring 48 is attached to the inner wall of the oil cylinder 51 and lifted to the top edge of the annular groove 56 to seal the gap between the upper edge of the piston body 49 and the inner wall of the oil cylinder 51, that is, seal the open oil path. Therefore, only the buffering oil path relieved in normal state remains between the upper and lower chambers 582, 581, that is, the gap between the lower section of the rotary shaft 41 and the piston body 49 is communicated with the upper and lower chambers through the oil vent 59 and the central shaft hole 60 so as to safely buffer the closing strength and speed. When the door is buffered and closed to the end, the expansion section 61 releases the gap between the expansion section and the oil seal ring 48 so that the buffering force is instantaneously lost. This permits the door to be closed to its true position.

The above embodiment is only an example of the present invention and the scope of the present invention should not be limited to the example. Any modification or variation derived from the example should fall within the scope of the present invention.

What is claimed is:

1. A hinge structure of rotary door, comprising a rotary hinge (10) adapted to be fixed to a door and a buffering rotary hinge (40) inserted in a hinge casing (31) of the rotary hinge, said hinge casing adapted to be fixed to the frame of the door, an upper section of a rotary shaft (41) of the buffering rotary hinge, having an upper ring seat 42' and a lower ring seat (42), a flange body being fitted around the rotary shaft between the upper ring seat (42') an the lower ring seat (42), an upper edge and a lower edge of the flange body and the upper ring seat and lower ring seat being respectively disposed with corresponding projecting wedge edges and recessed wedge edges, the flange body being formed with an insertion hole (46) engaged to said hinge casing and the lower ring seat (42) being formed with a slide slot (47) slidably engaged in the hinge casing (31), a piston body disposed with an oil seal ring being fitted with an end of the rotary shaft to be slidably disposed in an oil cylinder (51) having a mating seat at an end of the oil cylinder an oil seal body, a washer body and a cooperative latch ring (55) sealing an opening between the oil cylinder and the rotary shaft, a piston body being formed with a annular groove (56) communicating with a lower chamber by several through holes, the rotary shaft in the piston body being disposed with an oil vent (59) communicating with a central shaft hole (60) at an upper chamber of the oil cylinder, an end of an inner wall of the oil cylinder being formed with a expansion section, wherein the central shaft hole of the rotary shaft hole of the rotary shaft extends to a top thereof to be screwed with a rod member (68) with a conic head protruding through an intersection portion of the central shaft hole and the oil vent wherein when the door is rotated on the casing the flange body acts to move the piston body down against oil in the oil cylinder until pressure on the oil is released by upward movement of the rotary shaft by the flange body.

* * * * *